US006397558B1

(12) United States Patent
Yuyama et al.

(10) Patent No.: US 6,397,558 B1
(45) **Date of Patent: *Jun. 4, 2002**

(54) MEDICATION PACKING APPARATUS

(75) Inventors: Hiroyuki Yuyama; Keita Yasuoka, both of Osaka-fu (JP)

(73) Assignee: Yuyama Mfg. Co., Ltd., Toyonaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/422,461

(22) Filed: Oct. 21, 1999

(30) Foreign Application Priority Data

Oct. 23, 1998 (JP) ..... 10-302086

(51) Int. Cl.[7] ..... B65B 61/26
(52) U.S. Cl. ..... 53/131.4; 53/52
(58) Field of Search ..... 53/131.2, 131.4, 53/131.5, 168, 374.4, 52, 64, 201; 700/62, 231, 235

(56) References Cited

U.S. PATENT DOCUMENTS 4,733,362 A * 3/1988 Haraguchi ..... 364/479
5,208,762 A * 5/1993 Charhut et al. ..... 364/478
5,502,944 A * 4/1996 Kraft et al. ..... 53/55
5,761,877 A * 6/1998 Quandt ..... 53/155
5,839,836 A * 11/1998 Yuyama et al. ..... 400/62

FOREIGN PATENT DOCUMENTS

JP 10-101018 4/1998

* cited by examiner

*Primary Examiner*—Scott A. Smith
*Assistant Examiner*—Nathaniel Chukwurah
(74) *Attorney, Agent, or Firm*—Wenderoth, Lind & Ponack, L.L.P.

(57) ABSTRACT

A medicine packing apparatus for packing medicine to be taken at each dosing time into respective medicine bags in accordance with a packing order. The apparatus includes a device for inputting prescription data; a device for deciding packing order, i.e., whether the packing order is dosing order or reverse dosing order, on the basis of the prescription data; a device for preparing print data for each dosing time in accordance with the packing order decided by the device for deciding packing order; a device for setting packing data for each dosing time in accordance with the packing order decided by the device for deciding packing order; a device for printing the print data prepared by the device for preparing print data; and a device for packing the medicine in accordance with the packing data set by the device for setting packing data.

5 Claims, 7 Drawing Sheets

*Fig.4*

| PRESCRIPTION CLASSIFICATION CODE | PACKING ORDER |
|---|---|
| 01<br>(OUTPATIENT) | 0<br>(DOSING ORDER) |
| 02<br>(INPATIENT) | 1<br>(REVERSE DOSING ORDER) |
| ⋮ | ⋮ |

MEDICATION PACKING APPARATUS

TECHNICAL FIELD OF THE INVENTION

The present invention relates to a medicine packing apparatus for packing the medicine to be taken at each dosing time into respective medicine bag.

BACKGROUND OF THE INVENTION

In a conventional medicine packing apparatus, a long sheet is folded in two to form a plurality of medicine bags in a longitudinal direction. Medicine to be taken at each dosing time is continuously packed into the respective medicine bag which is in turn sealed. Thus, a medicine bag belt is formed.

In the medicine packing apparatus, however, the medicine is packed into each medicine bag only in dosing order, for example, "MORNING, MIDDAY, EVENING, MORNING, . . . ". Therefore, in the case of winding the medicine belt by a medicine belt winding apparatus as disclosed in Japanese Laid-open Patent Publication No. 10-101018, the wound medicine belt is suitable for distributing it but inconvenient for handling it because the wound medicine belt has to be unwound.

Moreover, the first dosing time is not limited to "MORNING". As to the dosing number, it is decided in one case on the basis of dosing days like "medicine for two days" or in the other case on the basis of dosing number like "medicine for five bags". Thus, it has been desired to conform the medicine packing apparatus to various dosing conditions.

SUMMARY OF THE INVENTION

Accordingly, an object of the present invention is to provide a medicine packing apparatus capable of freely packing the medicine on the basis of various dosing conditions.

The present invention provides, as a solution to the above-described problem with the prior art arrangements, a medicine packing apparatus for packing medicine to be taken at each dosing time into respective medicine bags in accordance with a packing order. The apparatus comprising:

- means for inputting prescription data;
- means for deciding packing order, i.e., whether the packing order is the dosing order or the reverse dosing order, on the basis of the prescription data;
- means for preparing print data for each dosing time in accordance with the packing order decided by said means for deciding packing order;
- means for setting packing data for each dosing time in accordance with the packing order decided by said means for deciding packing order;
- means for printing the print data prepared by said means for preparing print data; and
- means for packing the medicine in accordance with the packing data set by said means for setting packing data.

According to the present invention, when the packing order is changed to the reverse dosing order for the outpatient, the outpatient does not need to unwind the packed medicine belt, thereby enhancing convenience.

Preferably, said means for deciding packing order automatically determines the packing order on the basis of a prescription classification code in the prescription data, the prescription classification code comprising outpatient and inpatient.

Preferably, the medicine packing apparatus further comprises means for changing the packing order decided by said means for deciding packing order.

Preferably, the medicine packing apparatus further comprises a print data memory for storing the print data for each dosing time and a packing data memory for storing the packing data by assigning a column number to the packing data of each dosing time in the dosing order.

Preferably, if the packing order decided by said means for deciding packing order is the dosing order, said means for setting packing data obtains the packing data sequentially toward the next column number from the column number of dosing start time, while if the packing order decided by said means for deciding packing order is the reverse dosing order, said means for setting packing data obtains the packing data sequentially toward the previous column number from the column number of dosing finish time obtained from the dosing start time, dosing days and packing number.

BRIEF DESCRIPTION OF THE DRAWINGS

Further objects and advantages of the present invention will be become clear from the following description taken in conjunction with the preferred embodiments thereof with reference to the accompanying drawings, in which:

FIG. 4 is a diagram showing a packing order setting file;

DETAILED DESCRIPTION OF THE INVENTION

Figure 1:
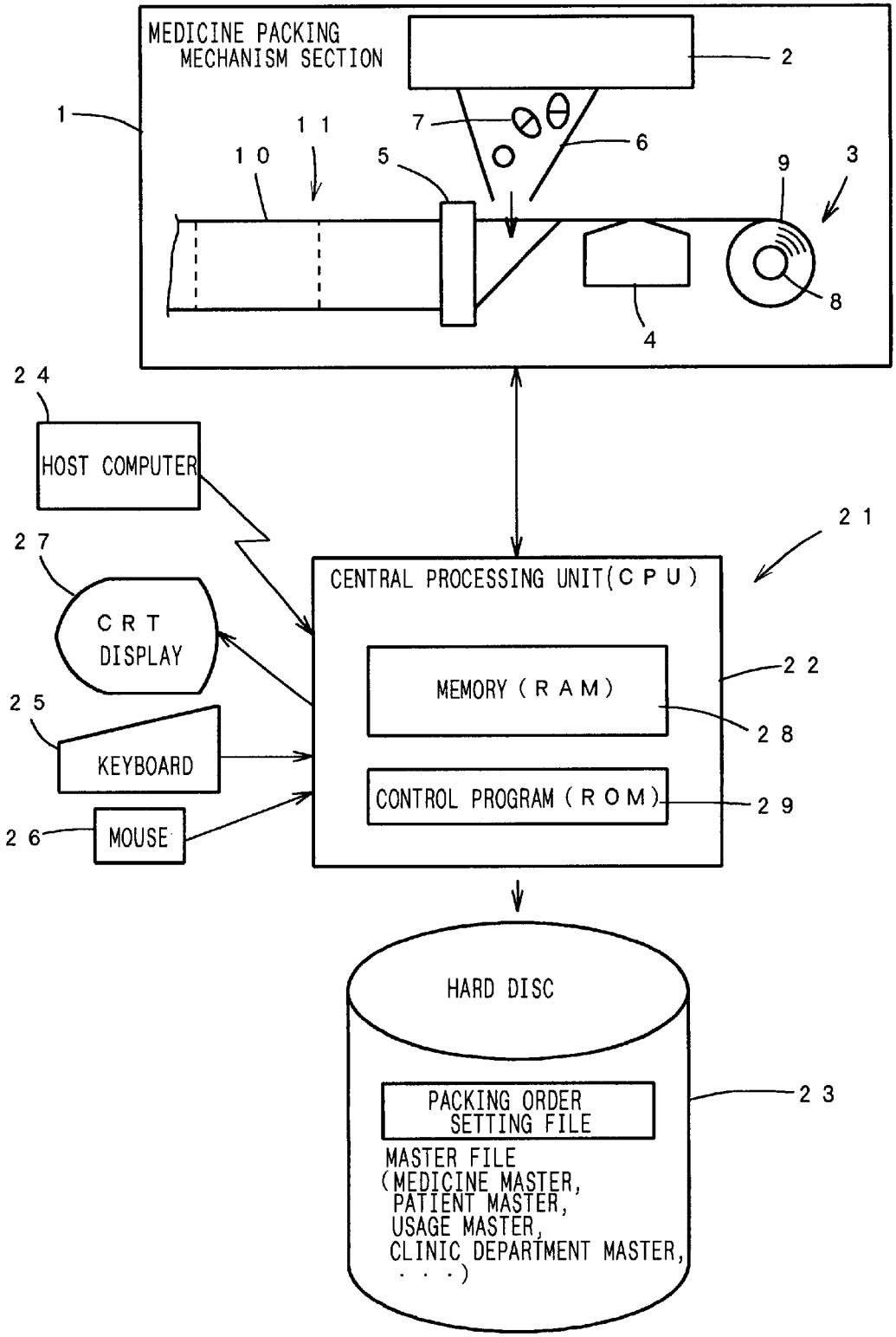
FIG. 1 is a block diagram of a medicine packing apparatus in accordance with an embodiment of the present invention.

FIG. 1 is a block diagram of a medicine packing apparatus in accordance with an embodiment of the present invention. The medicine packing apparatus comprises a medicine packing mechanism section 1 and a control section 21.

The medicine packing mechanism section 1 is provided with a medicine feed unit 2, a packing paper feed unit 3, a print unit 4 and a seal unit 5.

The medicine feed unit 2 is arranged to feed medicine 7, that is, tablets and/or powder for a dosing time to each packing bag 10 through a hopper 6.

The packing paper feed unit 3 comprises a roll 8 with packing paper 9 wound thereon. The packing paper feed unit 3 is arranged to unwind the packing paper 9 and feed it to the print unit 4 and the seal unit 5 to form a medicine belt 11.

The print unit 4 is arranged to print a predetermined information on the packing paper 9 fed from the packing paper feed unit 3 prior to forming the medicine belt 11.

The seal unit 5 is arranged to seal the packing paper 9, which is folded in two and into which the medicine 7 is contained, in order to form the medicine belt 11 comprising a plurality of medicine bags 10 in a longitudinal direction.

Figure 2:
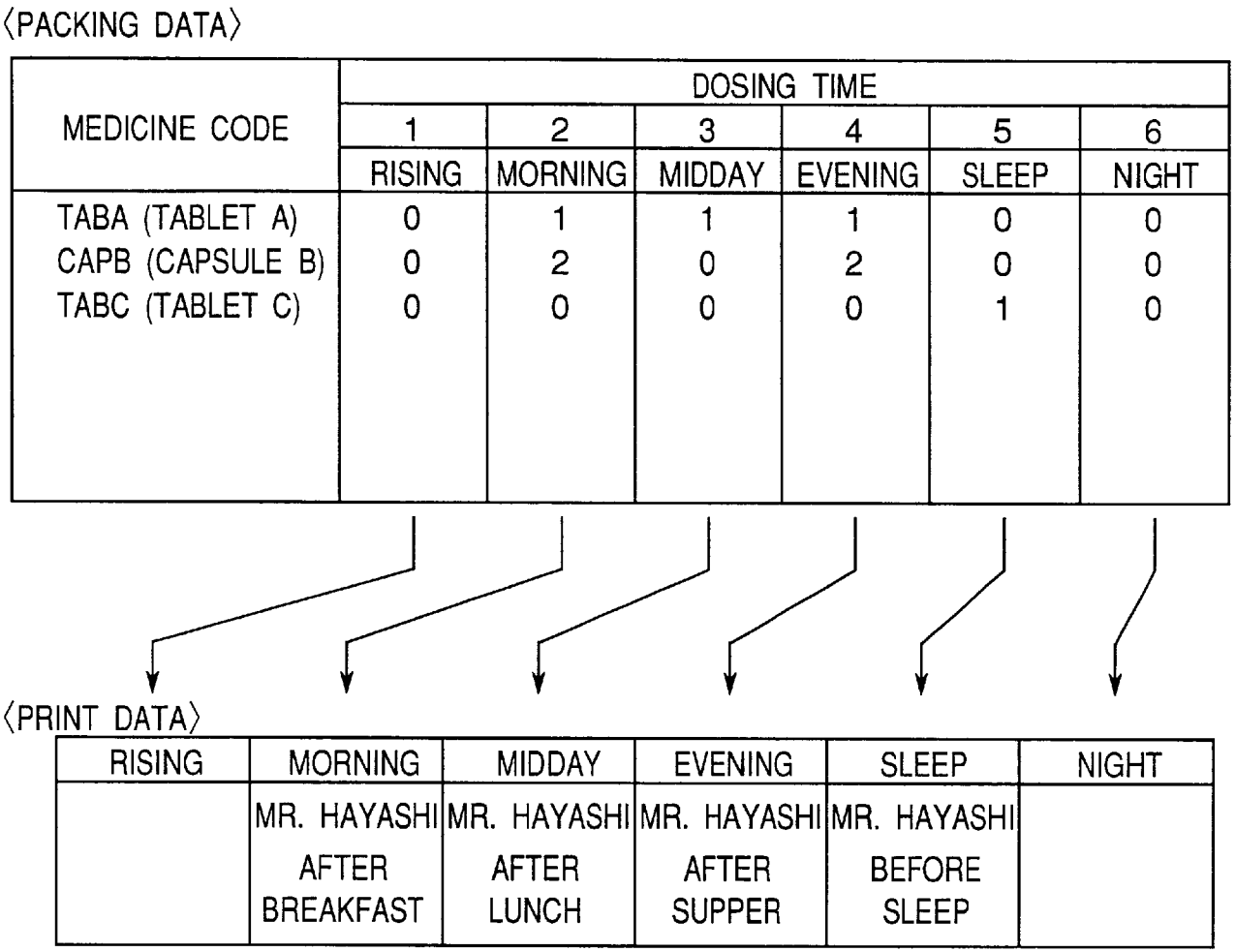
FIG. 2 is a diagram showing packing data and print data.

The control section 21 comprises a central processing unit (CPU) and a hard disc 23. The CPU can communicate with a host computer 24, a keyboard 25, a mouse 26 and a CRT display 27 and so on in order to conduct input/output of data. For example, from the host computer 24 the CPU 22 receives prescription data which comprises codes for the purpose of saving the quantity of transmission data. Then, the CPU 22 reads the medicine name data and so on corresponding to the codes from master files in the hard. disc 23. As a result, packing data and print data as shown in FIG. 2 are established. In the packing data, the column numbers are assigned to each dosing time and the dosing number of each medicine 7 is shown in each column number. The print data comprise information to be printed on each medicine bag 10 of each dosing time.

The CPU 22 includes a memory (RAM) 28 and a control program (ROM) 29. The memory 28 is used as a prescription data memory for storing prescription data, a packing data memory for storing packing data, a print data memory for storing print data, and other memories (work area, temporally area, variable and so on)

Figure 3:
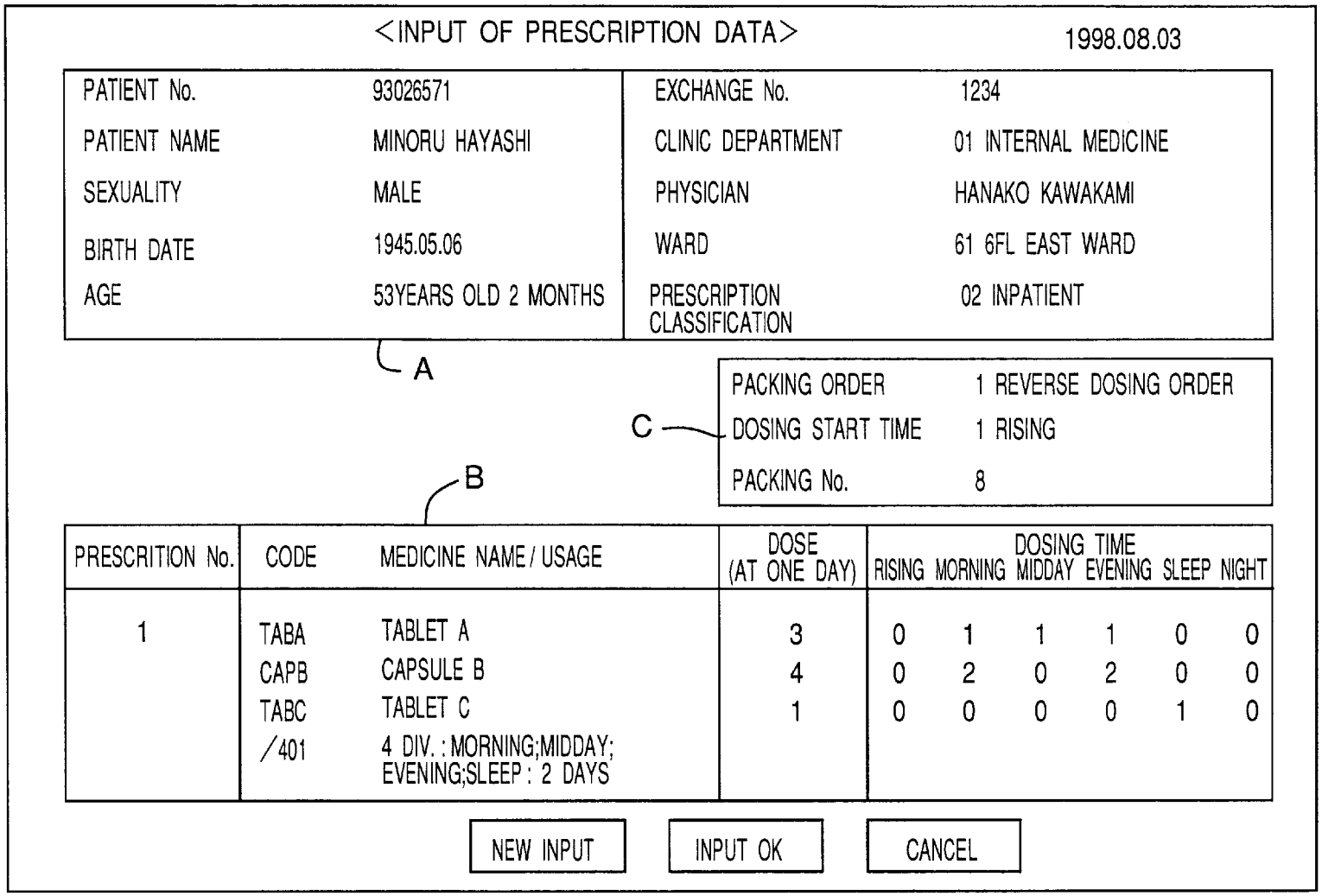
FIG. 3 is a prescription data input screen displayed on a CRT display of FIG. 1.

The CRT display 27 displays a prescription data input format. As shown in FIG. 3, the prescription data input format comprises a patient data portion A, a prescription data portion B, and a packing data portion C.

The patient data portion A includes patient data such as name, age, sexuality, and so on, and other data such as clinic department, physician, prescription classification and so on.

The prescription data portion B includes columns of "prescription No.", "code", "dose" and "dosing time". The column of "code" comprises items of "code" and "medicine name/usage". The item of "code" is a sort of abbreviation for a medication name. For instance, a medication name of "TABLET A" is used in the form of "TABA". The column of "dosing time" shows a dose of medicine at each dosing time in one day. In the present embodiment, the column of "dosing time" comprises six items of "RISING (at the time of rising)", "MORNING (after breakfast)", "MIDDAY (after lunch)", "EVENING (after supper)", "SLEEP (before sleep)" and "NIGHT (at night)". Alternatively, the column of "dosing time" may comprise items of "FIRST", "SECOND", . . . , and "SIXTH" which means each dosing time at every four hours in one day. The solid preparation such as tablet, capsule and pill is shown in its number, while the powder is shown in its weight (grams).

The packing data portion C includes items of "packing order", "dosing start time" and "packing number". The item of "packing order" is automatically decided on the basis of the prescription classification in the patient data portion A. "0" means dosing order, while "1" means reverse dosing order. The item of "dosing start time" shows a time when a patient starts taking medicine. Normally, "1; RISING" is indicated. If another dosing start time is desired, it can be changed by the keyboard or the like. The item of "packing number" shows a number obtained by multiplying a fraction of dosage data (packing No. per one day) by the number of days. If a smaller packing number is desired, it can be changed by the keyboard or the like.

The hard disc 23 includes a packing order setting file for storing packing order in each ;prescription classification and several master files for storing related information when inputting the prescription data.

The packing order setting file is used to set the packing order in each prescription classification code. The packing order setting file comprises a prescription classification code and a packing order as shown in FIG. 4. The data of the packing order setting file can be input by using the keyboard 25 or the mouse 26 on a packing order setting screen (not shown). The packing order setting screen is opened from a menu screen displayed on the CRT display 27.

The prescription classification code comprises codes registered in the prescription classification master file. In the packing order setting file shown in FIG. 4, prescription of "outpatient" is registered as "01", and prescription of "inpatient" is registered as "02". It is also possible to register "temporary", "emergency", "discharge" as "03", "04" and "05" respectively.

The packing order shows order for packing the medicine 7 into the medicine bag 10 of the medicine belt 11. If the medicine 7 is packed in dosing order, then the packing order is registered as "0". If the medicine 7 is packed in reverse dosing order, then the packing order is registered as "1". Then, the "outpatient" is set as dosing order, while the "inpatient" is set as reverse dosing order.

The several master files store codes and names corresponding to the codes. The master files include a medicine master, a patient master, an usage master, a clinic department master, a physician master, a hospital ward master, and a prescription classification master.

Figure 5:
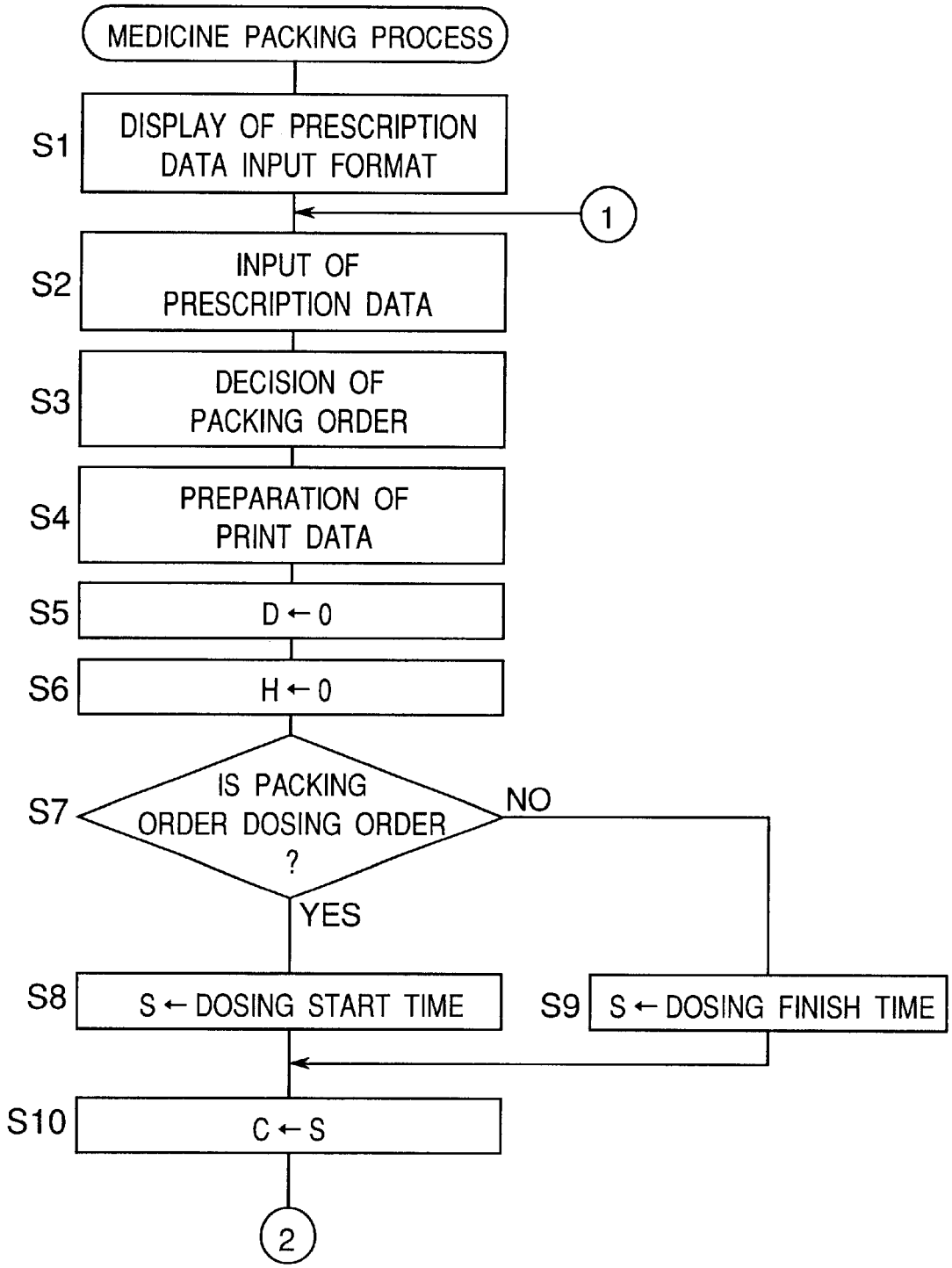
FIG. 5 is a flowchart showing. a medicine packing process.
Figure 6:
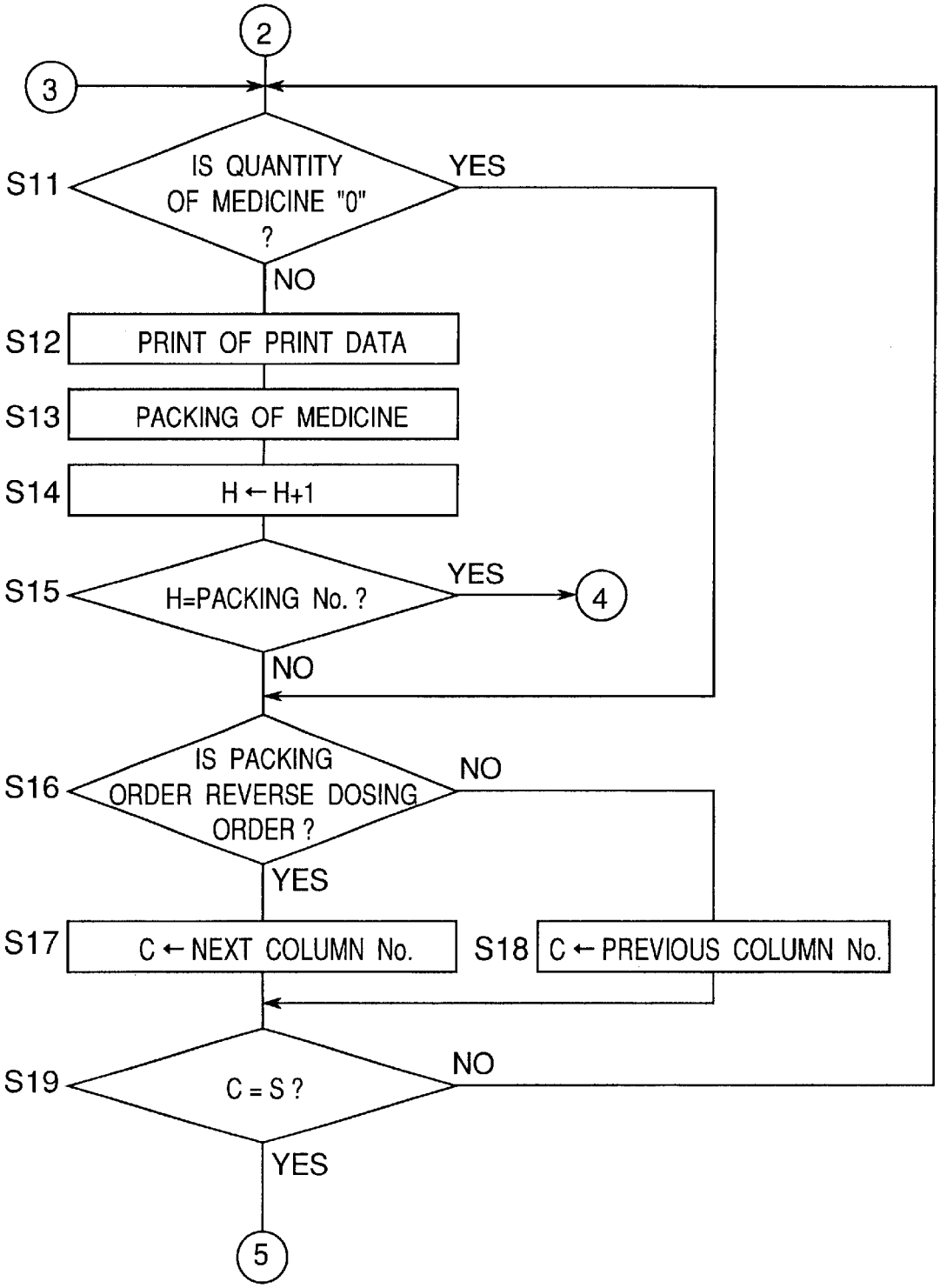
FIG. 6 is a flowchart continued from FIG. 5.
Figure 7:
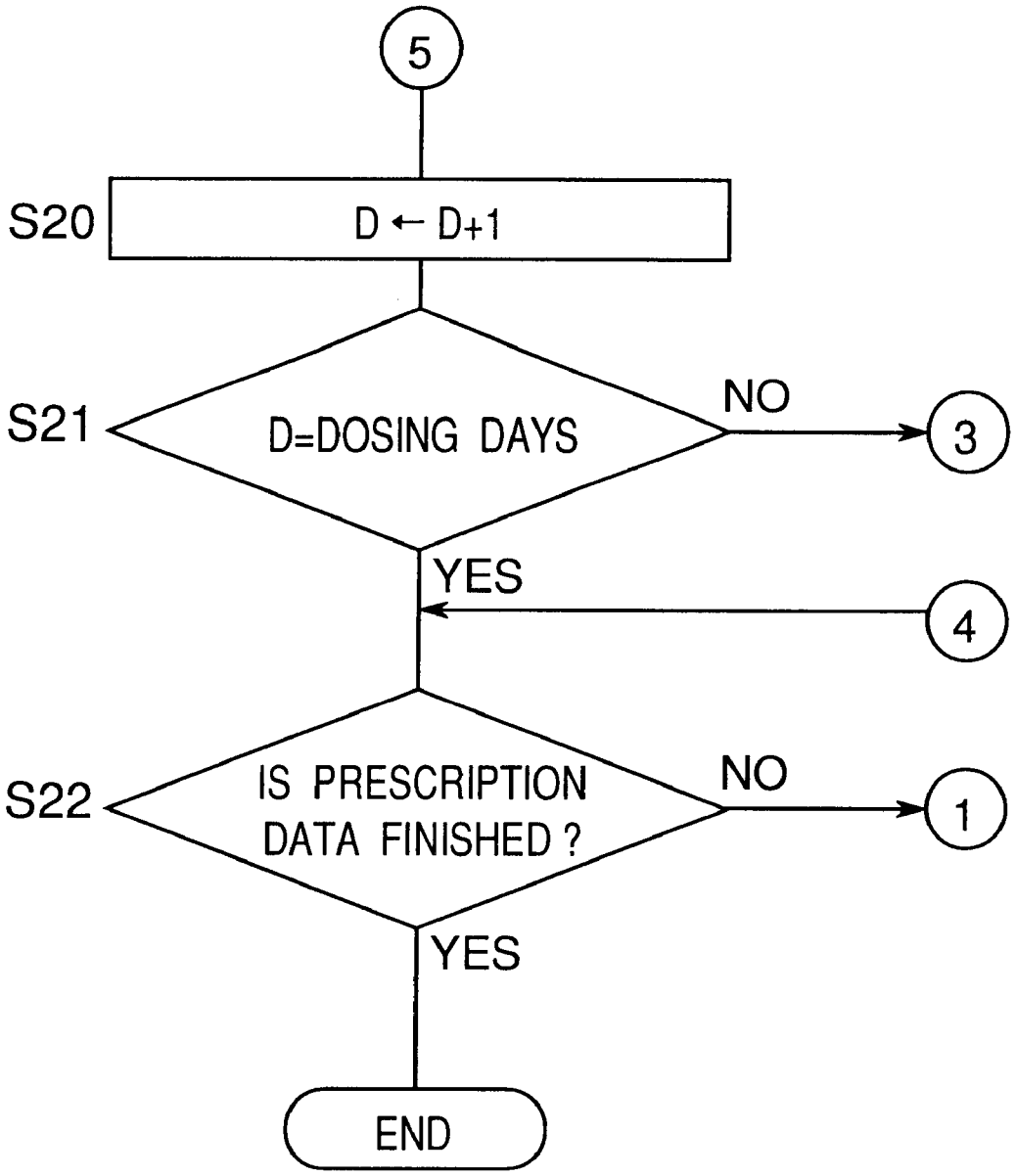
FIG. 7 is a flowchart continued from FIG. 6.

Operation executed in accordance with the control program 29 of the medicine packing apparatus having aforementioned construction will be explained with reference to flow charts as shown in FIGS. 5 to 7.

First of all, the prescription data input format is displayed on the CRT display 27 (Step S1) . Then, prescription data are input into the prescription data input format (Step S2). The input work of the prescription data is carried out by reading the prescription data from the host computer 24 and/or directly inputting the prescription data from the keyboard 25 or the mouse 26. The read data and input data comprise codes. The prescription data corresponding to the codes are read from the master files in the hard disc 23.

For example, in the prescription data portion B, when the medicine code "TABA" is input in the item of "code", the medicine name is read from the medicine master file. Then, the name of medicine "TABLET A" is displayed in the item of "medicine name/usage". When the symbol of "/" is input first and then the usage code of "401" is input, the usage is read from the usage master file. Then, the usage "4 DIVISION: MORNING; MIDDAY; EVENING; SLEEP" is displayed in the item of "medicine name/usage" The number of days for taking medicine can be directly input in the item of number of days. For example, if it is "2 days", "2" is input in the item of number of days.

Then, the packing order is decided (Step S3). The packing order is automatically decided on the basis of the prescription classification code in the prescription data and the set data read from the packing order setting file. In the case of outpatient, since the prescription classification code is "01", the packing order is decided as dosing order. In the case of inpatient, since the prescription classification code is "02", the packing order is decided as reverse dosing order. The packing order can be changed by using the keyboard and so on.

Subsequently, the print data for printing on the medicine bag 10 for each dosing time is prepared (Step S4). The print data is edited from patient name, usage etc. on the basis of the predetermined print format. In the concrete, as shown in FIG. 2, the print data comprises a patient name read from the prescription data and a usage read from the packing data.

Then, a day counter D and a packing number counter H are reset (Steps S5 and S6). The day counter H counts the number of days for which all bags are packed. The packing number counter H counts the number of packed bags. In an embodiment that neither indication of the number of packed bags nor input for correction is executed, step 6 is not necessary.

Subsequently, it is judged whether or not the packing order is the dosing order (Step S7).

If the packing order is the dosing order, then the column number 1 of "RISING" in the dosing start time is set in a register variable S (Step S8). On the other hand, if the packing order is the reverse dosing order, then the dosing finish time is obtained from the dosing start time, the dosing days, and the packing number. Thus, the column number corresponding to the dosing finish time is set in a register variable S (Step S9). The aforementioned dosing start time, the dosing days, and the packing number can be changed by using the keyboard and so on.

After the register variable S is set, the value thereof is assigned to an index variable C (Step S10). The index variable C shows the column number of the dosing time in the packing data shown in FIG. 2. Then, it is judged whether or not the quantity of all medicine 7 corresponding to the column number indicated by the index variable C is "0" (Step S11).

If the quantity of all medicine 7 corresponding to the column number indicated by the index variable C is "0", then execution is shifted to Step S16 without executing the next steps. In the case that the column number is 1 of "RISING" in FIG. 2, as the quantity of all medicine 7 is "0", next steps (Steps 12 to 15) are not executed.

On the other hand, if the quantity of all medicine 7 corresponding to the column number indicated by the index variable C is not "0", then the print data is printed on the corresponding medicine bag 10 (Step S12). In accordance with the packing data corresponding to the index variable C, the corresponding medicine 7 is packed into the medicine bag 10 printed at Step 12 (Step S13).

After the print to the medicine bag 10 and the pack of the medicine 7 on the basis of data corresponding to the index variable C are finished, "H+1" is assigned to the packing counter H (Step S14). Subsequently, it is judged whether or not the packing counter H comes up to the predetermined packing number set in the prescription data (Step S15). In an embodiment that neither indication of the number of packed bags nor input for correction is executed, step 6 is not necessary.

If the packing counter H comes up to the predetermined packing number, then it is judged whether or not the medicine-packing order is the dosing order (Step S16). If the medicine-packing order is the dosing order, the index variable C is updated to the next column number in the packing data (Step S17). On the other hand, if the medicine-packing order is the reverse dosing order, the index variable C is updated to the previous column number in the packing data (Step S18). Subsequently, it is judged whether or not the index variable C coincides with the register variable S (Step S19) . Namely, in the case that the medicine is packed in the dosing order, it is judged whether or not the value assigned to the index variable C coincides with the dosing start time. In the case that the medicine is packed in the reverse dosing order, it is judged whether or not the value assigned to the index variable C coincides with the dosing finish time.

Thus, Steps 11 to 18 are repeatedly executed until the index variable C coincides with the register variable S. When both coincide with each other, "D+1" is assigned to the day counter D (Step S20). Then, it is judged whether or not the day counter D coincides with the number of days for taking medicine (Step S21). Until both coincide with each other, Steps S11 to S20 are repeatedly executed. Subsequently, it is judged whether or not the previous executions are finished about all of the packing data (Step S22). Until it is finished, Steps S2 to S21 are repeatedly executed.

Hereinafter, in the case that the packing data as shown in FIG. 3 is input, the specific operation will be explained.

In the prescription data, the prescription classification code is "02; inpatient". Therefore, the packing order is decided as reverse dosing order. The print data is prepared as shown in FIG. 2.

The dosing start time is "1; RISING". The dosing time is "1; RISING, 2; MORNING, 3; MIDDAY, 4; EVENING, 5; SLEEP, 6; NIGHT". The quantity of medicine at the dosing times of "1; RISING" and "6; NIGHT" is "0". Therefore, the dosing finish time of "5; SLEEP" is set in the register variable S.

Then, the set register variable S ("5; SLEEP") is assigned to the index variable C. In present case, the quantity of medicine for the tablet C is "1" and the corresponding print data is present. Therefore, the print data of "MR. HAYASHI; SLEEP" is printed on the medicine bag 10. Then, one tablet C is packed into the printed medicine bag 10.

Subsequently, since the packing order is the reverse dosing order, the dosing time of "4; SUPPER" is assigned to the index variable C. In present case, the quantity of medicine for the tablet A is "1", the quantity of medicine for the capsule B is "2", and the corresponding print data is present. Therefore, the print data of "MR. HAYASHI; SUPPER" is printed on the medicine bag 10. Then, one tablet A and two capsules B are packed into the printed medicine bag 10.

Next, the dosing times of "3; MIDDAY", "2; MORNING", "1; RISING" and "6; NIGHT" are assigned to the index variable C sequentially, the same process as explained above is executed. Since the quantity of medicine at "1; RISING" and "6; NIGHT" is "0", the process of printing and packing are not executed.

In the prescription data, if the index variable C coincides with the register variable S, the process for one day is finished. Thus, the day counter D is increased and another process for next day is repeated from the dosing finish time of "5; SLEEP". In the prescription data, the number of days for taking medicine is two days. Therefore, if the value of the day counter D becomes "2" and coincides with the number of days for taking medicine, the process for printing and packing in the present prescription data is finished.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A medicine packing apparatus for packing medicine to be taken at each dosing time into respective medicine bags in accordance with a packing order, comprising:

means for inputting prescription data;

means for deciding a packing order on the basis of the prescription data, wherein the packing order is dosing order or reverse packing order;

means for preparing print data for each dosing time in accordance with the packing order decided by said means for deciding packing order;

means for setting packing data for each dosing time in accordance with the packing order decided by said means for deciding packing order;

means for printing the print data prepared by said means for preparing print data; and means for packing the medicine in accordance with the packing data set by said means for setting packing data.

2. The medicine packing apparatus as claimed in claim 1, wherein said means for deciding packing order automatically decides the packing order on the basis of prescription classification code comprising outpatient and inpatient.

3. The medicine packing apparatus as in claim 2, further comprising means for changing the packing order decided by said means for deciding packing order.

4. The medicine packing apparatus as in claim 1, further comprising a print data memory for storing the print data for each dosing time and a packing data memory for storing the packing data by assigning a column number to the packing data of each dosing time in the dosing order.

5. The medicine packing apparatus as in claim 4, wherein if the packing order/decided by said means for deciding packing order is the dosing order, said means for setting packing data obtains the packing data sequentially toward the next column number from the column number of dosing start time, while if the packing order decided by said means for deciding packing order is the reverse dosing order, said means for setting packing data obtains the packing data sequentially toward the previous column number from the column number of dosing finish time obtained from the dosing start time, dosing days and packing number.

* * * * *